US010370162B2

(12) United States Patent
Defert et al.

(10) Patent No.: US 10,370,162 B2
(45) Date of Patent: Aug. 6, 2019

(54) PERFORATOR CAP IN PARTICULAR FOR FLEXIBLE TUBE

(71) Applicant: ALBEA SERVICES, Gennevilliers (FR)

(72) Inventors: Sylvain Defert, Saint Ouen l'Aumone (FR); Franck Fritsch, Deuil la Barre (FR)

(73) Assignee: ALBEA SERVICES, Gennevilliers (FR)

( * ) Notice: Subject to any disclaimer, the term of this patent is extended or adjusted under 35 U.S.C. 154(b) by 121 days.

(21) Appl. No.: 15/490,892

(22) Filed: Apr. 18, 2017

(65) Prior Publication Data

US 2017/0297787 A1 Oct. 19, 2017

(30) Foreign Application Priority Data

Apr. 19, 2016 (FR) ..... 16 53452

(51) Int. Cl.

| | |
|---|---|
| ***B65D 51/22*** | (2006.01) |
| ***B65D 41/20*** | (2006.01) |
| ***B65D 41/04*** | (2006.01) |
| ***B65D 35/44*** | (2006.01) |

(52) U.S. Cl.

CPC ..... *B65D 51/225* (2013.01); *B65D 35/44* (2013.01); *B65D 41/0442* (2013.01); *B65D 41/20* (2013.01); *B65D 51/222* (2013.01); *B65D 51/223* (2013.01); *B65D 2251/0015* (2013.01); *B65D 2251/0093* (2013.01)

(58) Field of Classification Search

CPC .... B65D 51/225; B65D 51/222; B65D 41/20; B65D 41/205; B65D 35/44

USPC ..... 220/278, 258.4

See application file for complete search history.

(56) References Cited

U.S. PATENT DOCUMENTS

| | | | | |
|---|---|---|---|---|
| 4,595,434 A * | 6/1986 | Eckstein | ..... | B29C 65/3656 156/69 |
| 4,747,501 A | 5/1988 | Greaves | | |
| 5,947,318 A * | 9/1999 | Palm | ..... | B65D 5/746 220/278 |
| 2001/0047976 A1 | 12/2001 | Frank | | |

(Continued)

FOREIGN PATENT DOCUMENTS

| | | |
|---|---|---|
| EP | 0007869 | 6/1980 |
| FR | 2292635 | 6/1976 |
| JP | 2000033959 | 2/2000 |

*Primary Examiner* — Jeffrey R Allen
*Assistant Examiner* — Jennifer Castriotta
(74) *Attorney, Agent, or Firm* — Steven M. Greenberg, Esq.; Shutts & Bowen LLP

(57) ABSTRACT

The present invention relates to an assembly for the closure of a tube. The assembly includes a cap that includes a punch adapted to cut a seal. The seal is adapted to seal a neck of a tube head. The cap is configured to be fixed to the neck in a first position, known as the standby position, and a second position, known as the use position. The assembly also includes a ring movably fixed to the cap. The assembly is configured to allow the passage from an extended position, with the aim of the punch being protected by the ring in the standby position of the cap, to a retracted position, with the aim of the seal being pierced by the punch in the use position of the cap, a passage of the assembly from the extended position to the retracted position being effected by a sliding of the cap through the ring.

14 Claims, 2 Drawing Sheets

(56) References Cited

U.S. PATENT DOCUMENTS

| | | | | |
|---|---|---|---|---|
| 2006/0071000 | A1* | 4/2006 | Weist | B65D 5/748 220/278 |
| 2008/0093326 | A1* | 4/2008 | Cho | B65D 51/285 215/228 |
| 2013/0270293 | A1* | 10/2013 | Dresser | B65D 5/748 222/83 |
| 2014/0083879 | A1 | 3/2014 | Ulstad | |
| 2016/0194122 | A1 | 7/2016 | Kerman et al. | |

* cited by examiner

PERFORATOR CAP IN PARTICULAR FOR FLEXIBLE TUBE

CROSS REFERENCE TO RELATED APPLICATIONS

This application claims priority under 35 U.S.C. § 119(a) to French Patent Application Serial Number 1653452, filed Apr. 19, 2016, the entire teachings of which are incorporated herein by reference.

BACKGROUND OF THE INVENTION

Field of the Invention

The present invention relates to the field of flexible tubes including a seal that seals the neck before the tube is used for the first time, and a perforator cap adapted to pierce the seal.

Description of the Related Art

There are known tubes provided with a seal and associated with a perforator cap including a punch adapted to perforate the seal. This is because the seal keeps the product hermetically contained in the tube during storage before its first use, which represents a very significant portion of the overall lifespan of the tube. There are caps of which the punch is adapted to perforate the seal when the cap is inserted in a first direction in the neck of the tube, and to be screwed onto the neck when it is positioned in a second direction on the neck of the tube.

Such solutions can lead to having a tube that has a punch projecting from its cap during its use and storage. The punch, the extremity of which can be sharp, risks being damaged, damaging the other tubes or injuring the user. Other solutions have been proposed in which the punch is disposed in the cap, so as to be able to perforate the seal when the cap is screwed onto the tube head. In order to ensure that the seal is protected before the first use, a ring is disposed between the cap and the shoulder of the tube head, so as to hold the punch at a distance from the seal when the cap is screwed onto the neck.

To pierce and/or cut the seal, the user must first unscrew the cap, then remove the ring and finally screw the cap on again until the seal is pierced and/or cut. The number of steps is demanding for the user, who often does not understand what purpose is served by the ring and does not necessarily also understand that a seal must be pierced before the tube is used for the first time.

There is therefore a need for a perforator cap that overcomes at least partially the above-mentioned disadvantages.

BRIEF SUMMARY OF THE INVENTION

The present disclosure discloses an assembly for the closure of a tube. The assembly includes a cap including a punch adapted to cut a seal, the seal being adapted to seal a neck of a tube head, the cap being configured to be fixed to the neck in a first position, known as the standby position, and a second position, known as the use position, and a ring movably fixed to the cap. The assembly is configured to allow the passage from an extended position, with the aim of the punch being protected by the ring in the standby position of the cap, to a retracted position, with the aim of the seal being pierced by the punch in the use position of the cap, a passage of the assembly from the extended position to the retracted position being effected by a sliding of the cap through the ring.

Thus, when the cap is in the standby position and the assembly is in the extended position, in other words, before the tube is used for the first time, the punch, in particular its free extremity projecting from the cap, is then protected by the ring, reducing the risk of being damaged or of damaging the other tubes. The protection provided by the ring also enables the punch to be held at a distance from the seal that seals the neck and thus protecting the seal from any perforation or cutting, before the first use of the tube by a user. In addition, the sliding of the cap through the ring enables the seal to be cut and/or pierced without the ring having to be removed, producing a not inconsiderable time saving for the user.

According to different embodiments of the invention, which can be taken together or separately:

- the assembly is configured so that the passage from the retracted position to the extended position is reversible;
- the ring and the cap are coaxial;
- the cap and the ring are two separate parts;
- the ring is made of a transparent material;
- the assembly includes at least one projecting element;
- the projecting element is configured to cooperate with at least one groove for the passage from the extended position to the retracted position;
- the at least one projecting element is provided on the ring;
- the groove is provided on the cap;
- the projecting element and the groove are configured to perform a bayonet-type movement;
- the projecting element or elements are situated on an inner surface of the ring;
- the ring includes a plurality of projecting elements;
- the plurality of projecting elements is distributed regularly on the periphery of the ring;
- the projecting element or elements are one or more than one pin;
- the groove is L-shaped;
- the groove includes a first stop so that the assembly is held in the extended position;
- the cap includes guiding means so that one of the projecting elements of the ring cooperates with the groove;
- the guiding means are situated at a lower extremity of the groove;
- the cap includes a gripping portion and a skirt projecting axially from the gripping portion;
- the ring has an inner diameter greater than the outer diameter of the skirt, so as to allow the skirt to slide through the ring;
- the groove is situated on an outer surface of the skirt;
- the skirt includes a first bead adapted to cooperate with the projecting element or elements so as to allow the ring to be snap-fitted to the skirt of the cap in order to fit the assembly together;
- the first bead is situated on a lower portion of the skirt;
- the first bead enables the ring to be held assembled on the cap with a degree of freedom in rotation;
- the skirt includes a second bead adapted to cooperate with the projecting element or elements so as to hold the assembly in the retracted position;
- the cap is configured to be fixed by screwing or snap fitting in the standby position and/or in the use position;
- the cap, in particular an inner surface of the skirt, has a first thread configured to screw the cap onto the neck, in the use position;

the cap further includes a second thread situated at an extremity opposite the punch, the second thread being configured to screw the cap onto the neck in the standby position of the cap;

the second thread is shorter than the first thread;

the cap further includes a bead, known as the third bead, configured to snap-fit the cap to the neck in the standby position of the cap;

the third bead is situated at an extremity opposite the punch.

The invention also relates to a tube including an assembly as described above.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
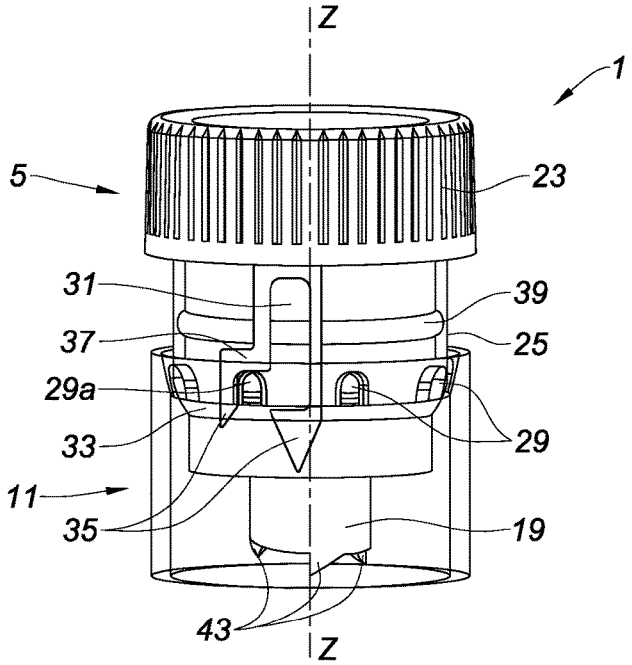
FIG. 1 shows a perspective view of a tube closure assembly according to an aspect of the invention.

As shown in FIG. 1, the disclosure relates to an assembly 1 for the closure of a tube 3. The assembly includes a cap 5 configured to be fixed to a neck 7 of a tube head 9, and a ring 11 movably fixed to the cap 5. The tube head 9, a variant of which is shown in FIGS. 2 to 6, includes a neck 7 defining a longitudinal axis Z-Z, a shoulder 13 and a solid insert 15 forming a seal 17 that seals the neck 7, in the lower portion thereof. More specifically, the insert 15 includes a peripheral section, typically cone- or disc-shaped, and a central section forming the seal 17, the diameter of which typically corresponds to the inner diameter of the neck 7.

Generally, the cap 5 includes a punch 19 projecting from the cap 5, in particular the punch is integral with the cap. The punch 19 is configured so as to be inserted inside the neck 7 of the tube head 9 when the cap 5 is fixed to the neck 7. A longitudinal direction of the cap 5, corresponding to the longitudinal axis Z-Z of the neck 7, is defined when the cap 5 is fixed to the neck 7.

Figure 4:
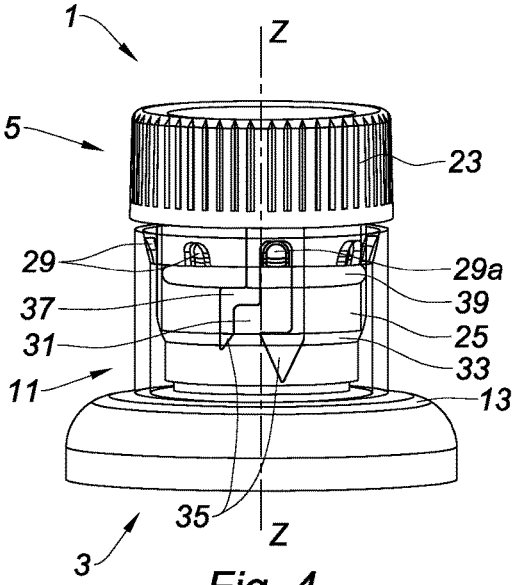
FIG. 4 reproduces FIG. 2 with the closure assembly in a retracted position.
Figure 5:
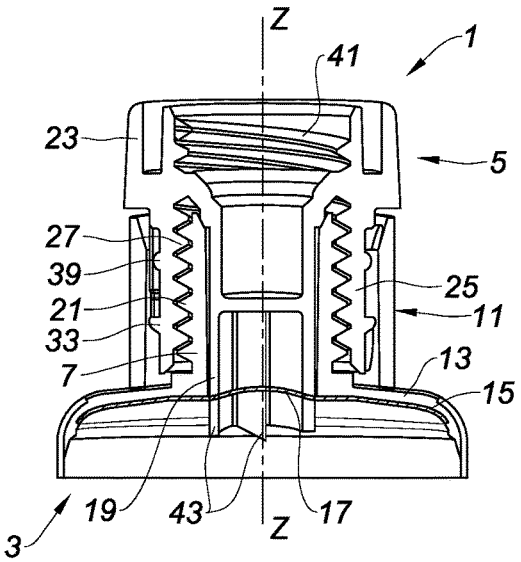
FIG. 5 is a view in axial cross section of FIG. 4.

According to the present invention, the cap 5 is, in addition, configured to be fixed to the neck 7 in a first position, known as the standby position (FIGS. 1, 2 and 6), and a second position, known as the use position (FIGS. 4 and 5). The assembly 1 is thus configured to allow the passage from an extended position with the aim of the punch 19 being protected by the ring 11, in the standby position of the cap 5, to a retracted position with the aim of the seal 17 being pierced by the punch 19 in the use position of the cap 5. The passage of the assembly 1 from the extended position to the retracted position is effected by a sliding of the cap 5 through the ring 11, the ring 11 and the cap 5 being, in this instance, coaxial.

The cap 5 can also comprise an internal thread adapted to cooperate with a thread 21 situated on the outer periphery of the neck 7. The cap 5 is then fixed by screwing to the neck 7, in particular in the standby and/or in the use position.

In the embodiments shown in the different figures, the cap 5 includes a gripping portion 23 and a skirt 25 projecting axially from the gripping portion 23. An inner surface of the skirt 25 has a first thread 27 (inner thread mentioned above) configured to screw the cap 5 onto the neck 7, in the use position.

Thus, in these embodiments, the ring 11 has an inner diameter greater than the outer diameter of the skirt 25, so as to allow the sliding of the skirt 25 through the ring 11. In other words, the skirt 25 is situated inside the ring 11, either for a part of its length in the extended position, or for its entire length in the retracted position.

Advantageously, the sliding is allowed by the presence of at least one projecting element 29 on the ring 11 and at least one groove 31 of the cap 5.

Here, the ring 11 includes a plurality of projecting elements 29 configured to cooperate with a single groove 31 of the cap 5 for the passage from the extended position to the retracted position, in a bayonet-type movement.

Here, the projecting elements are pins 29 distributed regularly on the periphery of an inner surface of the ring 11 and the groove 31 is situated on an outer surface of the skirt 25 and is L-shaped.

Initially, the cap 5 and the ring 11 being two separate parts, the ring 11 is movably fixed to the cap 5 (FIG. 1). Advantageously, the ring 11 is fixed by snap-fitting to the cap 5 by cooperation of the projecting elements 29, here some pins 29 of the ring 11 with a first bead 33 of the skirt 25. The ring 11 is thus held fitted on the cap 5 with a degree of freedom in rotation. The assembly 1 is then in the extended position and the cap 5 in a standby position. The punch 19 is protected by the ring 11. In other words, the free extremity of the punch 19 projecting from the cap 5 is inside the ring 11 and does not extend beyond the ring.

During the snap-fitting one of the projecting elements 29 (referenced 29*a*) is guided into the groove 31 of the cap 5 so as to engage therein. To facilitate this engagement, the cap 5 includes guiding means 35. In particular, the groove 31 has a pointed shape at its lower extremity, that is, at its entrance, which enables one of the pins 29*a* to be guided thereinto, in particular into a first branch thereof situated in a plane at right-angles to the axis Z-Z of the cap. The plurality of projecting elements 29 ensures that, whatever the position of the ring 11 in relation to the cap 5, at least one of the elements 29 is close to the groove 31 in order to be able to engage therein.

To prevent the skirt 25 from sliding completely into the ring 11 and so an unintended passage from the extended position to the retracted position, the groove 31 has a first stop 37 immobilising the pin 29*a* engaged therein and stopping the sliding of the cap 5 through the ring 11 towards the retracted position. Advantageously, the first stop 37 is provided by a particular shape of the groove 31, in particular the L-shape already mentioned.

Advantageously, the ring 11 can be made of a transparent material. The user can thus see the presence of the punch 19 and understand more intuitively that the punch must be inserted in the neck 7 so as to cut and/or pierce a seal 17 formed in the neck 7.

Figure 2:
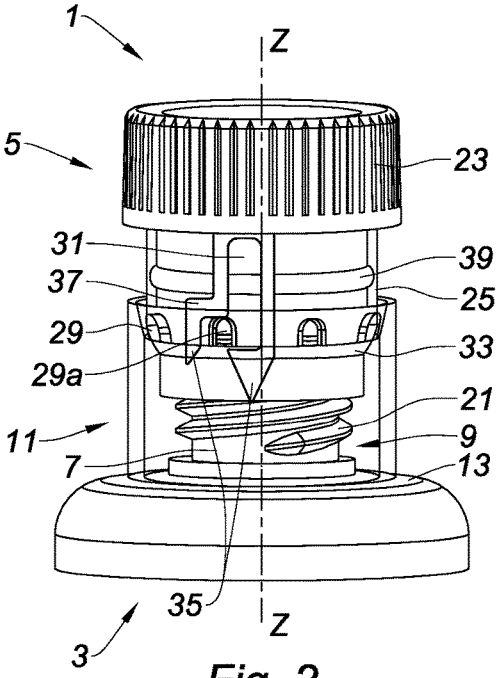
FIG. 2 shows a perspective view of a tube, partially illustrated, including the closure assembly of FIG. 1 in an extended position.
Figure 3:
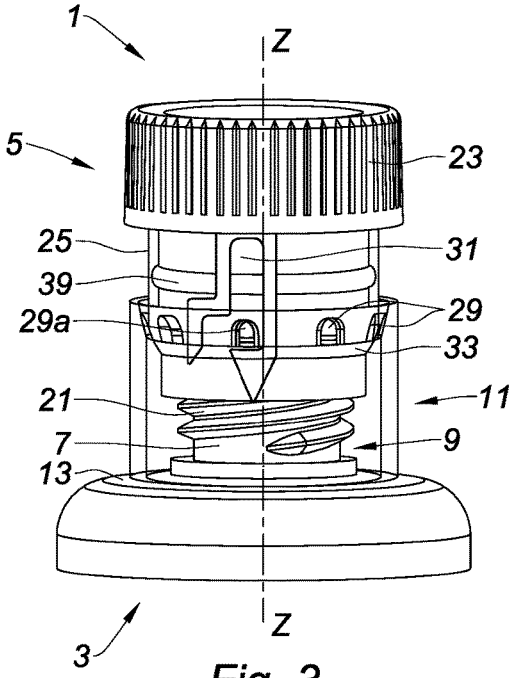
FIG. 3 reproduces FIG. 2 with the closure assembly in an intermediate position.

The cap 5 is next positioned on the neck 7 so that the assembly 1 is still in its extended position and the cap 5 is in its standby position (FIG. 2). The ring 11 is thus disposed around the neck 7, bearing against the shoulder 13. The punch 19 then extends inside the neck 7. The ring 11 is, in addition, configured so as to maintain a spacing between the cap 5 and the shoulder 13 in order to hold the punch 19 at a non-zero distance from the insert 15 when the cap 5 is positioned on the neck 7. The punch 19 is thus prevented from coming into contact with the insert 15 and from piercing and/or cutting the seal 17 formed in the neck 7.

Advantageously, the restriction of the sliding of the skirt 25 in the ring 11 obtained by virtue of the stop 37 ensures here that the punch 19 remains at a distance from the seal 17, and that the latter is protected from any cutting and/or perforation.

Lastly, the cap 5 is screwed onto the neck 7 by the user. The pin 29*a* engaged in the groove 31 then continues its progression so that the assembly 1 passes from the extended position to the retracted position and the cap 5 passes from the standby position to the use position.

The cap 5 passes first of all into an intermediate position (FIG. 3) in which the user has begun screwing the cap 5 onto the neck 7. The pin 29*a* is then in a position in which it is released from the first stop 37 and can perform, in a second branch of the groove, perpendicular to the first branch, an upward movement along the axis Z-Z causing the cap 5 to slide through the ring 11 and the assembly 1 to pass from the extended position to the retracted position (FIGS. 4 and 5).

Thus, in the retracted position of the assembly 1 and in the use position of the cap 5 visible in FIGS. 4 and 5, the cap 5 is screwed onto the neck 7, for example until it comes into abutment against the shoulder 13 or a rim of the neck 7. The punch 19 has then made a cut and/or a perforation in the insert 15, and more specifically in its central portion forming the seal 17 of the tube head 9 as can be seen in FIG. 5.

Here, the skirt 25 includes a second bead 39 adapted to cooperate with the projecting elements 29 so as to hold the assembly 1 in the retracted position once the cap 5 has been unscrewed and withdrawn from the neck 7. The assembly 1 could also be configured so that the passage from the retracted position to the extended position is reversible.

Figure 6:
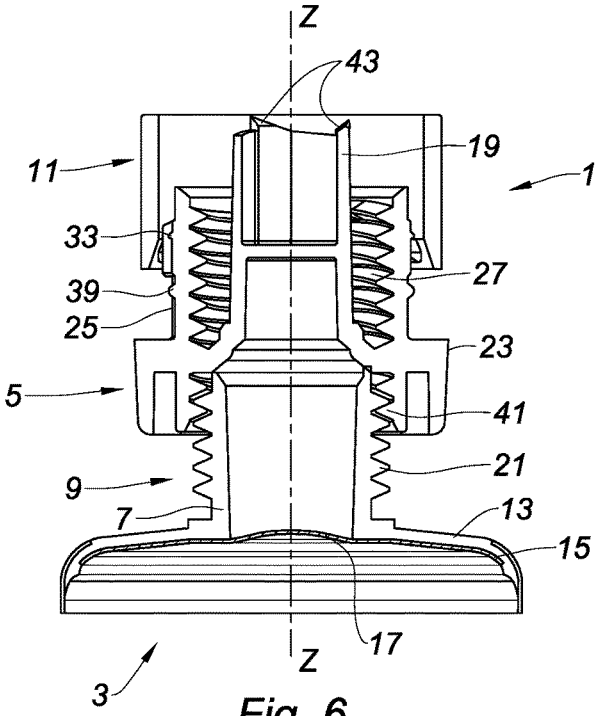
FIG. 6 is a view in axial cross section of the closure assembly of FIG. 1, in the standby position, according to a particular embodiment.

In the embodiment shown in FIG. 6, the cap 5 further includes a second thread 41 situated at an extremity opposite the punch 19. The second thread 41 is configured to be screwed onto the neck 7 in the standby position of the cap 5.

In this embodiment, during the first use, the user unscrews the cap 5 from the neck 7, then turns the cap 5 over and screws it back onto the neck 7 causing a sliding of the cap 5 through the ring 11 as described above, in relation to FIGS. 2 to 5, so that the punch 19 makes a cut or a perforation in the insert 15, and more specifically in its central portion forming the seal 17 of the tube head 9.

Advantageously and as shown here, the second thread 41 is shorter than the first thread 27 situated at the skirt 25, that is, it includes a smaller number of turns in comparison with the first thread 27. During the first use, the user can thus rapidly unscrew the cap 5, turn it over and screw it back onto the neck 7 to pierce/cut the seal 17.

It is also possible to envisage an embodiment (not shown) in which the cap is configured to be fixed by snap-fitting to the neck in the standby position. The cap can thus comprise a bead, known as the third bead, situated at an extremity opposite the punch, for example as a substitute for the second thread of the cap.

The cutting of the seal 17 is advantageously partial, so that the portion or portions of the seal 17 that have been cut remain connected to the rest of the insert 15, thus preventing any mixture of the material forming the insert 15 with a product contained in the associated tube 3, and any dispensing of this material to the user.

Generally, the punch 19 has a cylindrical section of revolution, of which a free extremity is advantageously provided with cutting means so that when the cap 5 is screwed onto the neck 7 of the tube head 9, the free extremity of the punch 19 is inserted into the neck 7. The cutting means can be a bevelled shape of the free extremity, teeth and/or cutting notches, for example, regularly distributed on the periphery of the free extremity of the punch 19. The specimen punch 19 shown in FIGS. 1, 5 and 6 is a punch 19 with a cylindrical section of revolution, the free extremity of which is provided with three teeth 43 of low height and distributed regularly on the periphery of its free extremity.

Other embodiments can be envisaged that enable the cap to slide through the ring in order to pass from the extended position to the retracted position of the assembly. In particular, it is possible that the groove or grooves and the projecting element or elements are reversed, that is, the ring includes at least one groove configured to cooperate with at least one projecting element of the cap.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are pos-sible without departing from the scope of the invention defined in the appended claims as follows:

1. An assembly for the closure of a tube, said assembly comprising:

a cap comprising a punch adapted to cut a seal, said seal being adapted to seal a neck of a tube head, said cap comprising two different positions in which said cap is fixed to said neck, said positions comprising a first position, known as the standby position, and a second position, known as the use position, and, a ring movably fixed to said cap, said assembly being configured to allow a passage from an extended position of the assembly, with the aim of said punch being protected by said ring in the standby position of said cap, to a retracted position of the assembly, with the aim of said seal being pierced by said punch in the use position of said cap, the change of the assembly from the extended position of the assembly to the retracted position of the assembly being effectuated by a sliding of the cap through the ring, said ring comprising at least one projecting element configured to cooperate with at least one groove of said cap for the change of the assembly from the extended position to the retracted position, said cap comprising a first thread configured to screw said cap onto said neck, in the use position of the cap.

2. The assembly according to claim 1, wherein said projecting element and said groove are configured to perform a bayonet-type movement along an L-shaped path.

3. The assembly according to claim 1, wherein said groove is L shaped.

4. The assembly according to claim 1, wherein the projecting element or elements are situated on an inner surface of said ring.

5. The assembly according to claim 1, wherein said ring comprises a plurality of projecting elements.

6. The assembly according to claim 5, wherein said plurality of projecting elements is distributed regularly on the periphery of said ring.

7. The assembly according to claim 1, wherein said groove comprises a first stop so that the assembly is held in the extended position.

8. The assembly according to claim 1, wherein said cap comprises a gripping portion and a skirt projecting axially from said gripping portion, said ring having an inner diameter greater than the outer diameter of said skirt, so as to allow said skirt to slide through the ring.

9. The assembly according to claim 8, wherein said skirt comprises a first bead adapted to cooperate with said at least one projecting element so as to allow said ring to be snap-fitted to said skirt of said cap in order to fit said assembly together.

10. The assembly according to claim 9, wherein said first bead enables said ring to be held assembled on said cap with a degree of freedom in rotation.

11. The assembly according to claim 9, wherein said skirt comprises a second bead adapted to cooperate with said at least one projecting element so as to hold said assembly in the retracted position.

12. The assembly according to claim 1, wherein said cap has a first thread configured to screw said cap onto said neck, in the use position of the cap, and said cap further comprises a second thread situated at an extremity opposite said punch, said second thread being configured to screw said cap onto said neck in the standby position of the cap.

13. The assembly according to claim 12, wherein the second thread is shorter than the first thread.

14. A tube comprising a closure assembly, said assembly comprising:

a cap comprising a punch adapted to cut a seal, said seal being adapted to seal a neck of a tube head, said cap being configured to be fixed to said neck in a first position, known as the standby position, and a second position, known as the use position, and, a ring movably fixed to said cap, said assembly being configured to allow a passage from an extended position of the assembly, with the aim of said punch being protected by said ring in the standby position of said cap, to a retracted position of the assembly, with the aim of said seal being pierced by said punch in the use position of said cap, the change of said assembly from the extended position to the retracted position being effected by a sliding of the cap through the ring, said ring comprising at least one projecting element configured to cooperate with at least one groove of said cap for the change from the extended position to the retracted position, said cap comprising a first thread configured to screw said cap onto said neck, in the use position of the cap.

* * * * *